US007504960B2

(12) United States Patent
McGrath

(10) Patent No.: US 7,504,960 B2
(45) Date of Patent: Mar. 17, 2009

(54) REMOTELY LOCATED BATTERY FOR A SMOKE DETECTOR

(75) Inventor: Patrick McGrath, 4135 Lily Dr., Roy, UT (US) 84067

(73) Assignee: Patrick McGrath, Roy, UT (US)

( * ) Notice: Subject to any disclaimer, the term of this patent is extended or adjusted under 35 U.S.C. 154(b) by 346 days.

(21) Appl. No.: 11/557,875

(22) Filed: Nov. 8, 2006

(65) Prior Publication Data

US 2007/0103330 A1 May 10, 2007

Related U.S. Application Data

(60) Provisional application No. 60/736,042, filed on Nov. 10, 2005.

(51) Int. Cl.
*G08B 21/00* (2006.01)

(52) U.S. Cl. ..... 340/636.1; 340/628; 340/693.1; 340/693.9; 340/693.11; 340/693.12; 340/286.05

(58) Field of Classification Search ..... 340/636.1, 340/628, 629, 630, 632, 693.1, 693.5, 693.6, 340/693.7, 693.9, 693.11, 693.12, 870.17, 340/286.05

See application file for complete search history.

(56) References Cited

U.S. PATENT DOCUMENTS 4,365,237 A * 12/1982 Knight ..... 340/521
5,587,705 A * 12/1996 Morris ..... 340/628

* cited by examiner

*Primary Examiner*—Hung T. Nguyen
(74) *Attorney, Agent, or Firm*—Kirton & McConkie; Evan R. Witt

(57) ABSTRACT

A remote battery access device for remotely and conveniently positioning the battery of a smoke detector from the smoke detector. The remote battery access device includes a battery module having a battery holder shaped to retain the battery. The remote battery access device may also include an electrical connector for electrically connecting the battery module to the smoke detector and a plurality of wires connecting the electrical connector with the battery module, which permit the smoke detector to be disposed remotely from the battery module.

20 Claims, 8 Drawing Sheets

REMOTELY LOCATED BATTERY FOR A SMOKE DETECTOR

CROSS-REFERENCE TO RELATED APPLICATION

This application claims the benefit of U.S. Provisional Application No. 60/736,042, filed Nov. 10, 2005, which application is incorporated by reference.

BACKGROUND OF THE INVENTION

This invention relates generally to battery powered smoke detectors and smoke detectors having back-up batteries that are used in residential and commercial buildings. More specifically, the invention is directed to a battery access device that is located remotely from a smoke detector to permit convenient changing and monitoring of the battery.

A common problem and frustration with current smoke detectors is the difficulty and inconvenience in changing the battery that is held within its housing. First, smoke detectors are typically attached to the ceiling of a room. Where the ceiling of a room is vaulted, the smoke detector is often located near the top of a vaulted ceiling. Consequently, a ladder or chair must often be used to boost a person into position to access the smoke detector to change the battery. Additionally, some disabled people, including persons confined to a wheel chair, are physically incapable of accessing the smoke detector and thus, must rely on another person to change the battery in a smoke detector. Moreover, some elderly people and others with impaired balance should not climb on chairs and ladders such that it would be unsafe for them to change the battery in a smoke detector.

Second, some smoke detectors have a housing whose faceplate must be removed in order to change the battery. Often, the faceplate is difficult to properly replace, so that the smoke detector may be inadvertently damaged during replacement or the faceplate may fall off after the battery has been replaced providing an unsightly view to occupants of the room until someone is willing access the smoke detector and replace its faceplate.

Third, because smoke detectors are typically located above the person seeking to change its battery, the battery may be improperly oriented when installed in the smoke detector. In some cases, improperly installing a battery may damage the smoke detector. Additionally, the battery may not properly contact the electrical contacts of the smoke detector, which may prevent the battery from powering the smoke detector.

As a result of these difficulties, spent batteries are often not replaced or even initially installed in smoke detectors. As a result, the smoke detectors do not function properly to warn the occupants of the building of a growing fire which can cause the unnecessary loss of life and property.

Accordingly, a need exists for a means for providing the convenient installation or replacement of the battery of a smoke detector. Furthermore, a need exists for a means to easily discern whether a battery is currently connected to a smoke detector. A need also exists for a convenient way to discern the status of the battery within the smoke detector.

BRIEF SUMMARY OF THE INVENTION

The apparatus and system of the present invention has been developed in response to the present state of the art, and in particular, in response to the problems and needs in the art that have not been fully solved by currently available smoke detectors. Thus, the present invention provides a remote battery access device for providing convenient access to monitor, install, and replace the battery of a smoke detector. As used herein, the terms "remote" and "remotely" refer to the physical spacing and separation of the battery access device and the smoke detector. In many cases, the smoke detector will be installed on a ceiling and the battery access device will be installed on a wall. They may be separated by five, ten, fifteen, twenty, thirty or more feet.

In accordance with the invention as embodied and broadly described herein in the preferred embodiment, a remote battery access device for a smoke detector is provided. The remote battery access device of the invention permits the battery of a smoke detector to be remotely located from the smoke detector in a convenient location. Thus, remote battery access device of the invention permits elderly and disabled persons to safely change and monitor the battery of a smoke detector without having to physically access the smoke detector.

The remote battery access device of the invention generally includes a battery module including a battery holder for holding a battery and wires for electrically connecting the battery held by the battery holder to the smoke detector. For retrofitting an existing smoke detector or where a remote battery access device has not been integrated with a smoke detector, the remote battery access device may also include an electrical connector for electrically connecting the wires and battery module to a smoke detector.

For example, the electrical connector may be a 9V battery snap connector attached to the end of the wires for connecting the battery module of the remote battery access device to the contacts of a smoke detector. Alternatively, a cap may be used to protect the ends of the wires and the battery wires of the smoke detector once they are twisted together to electrically connect the battery held by battery module with the with the smoke detector.

In another alternative, the electrical connector may be a structure shaped similarly to a battery that permits the battery module to be connected to the any smoke detector. The structure includes a positive terminal and a negative terminal that are brought into contact with the respective contacts of the smoke detector. By simulating the dimensions of a battery, the structure may be placed within the battery compartment of any smoke detector to contact the existing contacts of the smoke detector like an ordinary battery. For example, 9V batteries are commonly used to provide battery power to smoke detectors, and thus, the structure may be dimensionally similar to a 9V battery. Of course, other battery sizes may be simulated.

The wires extend from the electrical connector and connect to the remotely disposed battery holder of the battery module. The battery module may include a housing that may be positioned on and attached to a wall of a room of a building. In some configurations, the battery module may be combined with a light switch or electrical socket installed in a housing that includes a double gang electrical box. It may be desirable, or necessary according to local building codes, to provide a divider to separate the low voltage wiring associated with the battery from high voltage wiring associated with a light switch or electrical socket. Of course, the housing of the battery module may include a single, triple, or more gang electrical box, or alternatively, may include a housing shaped for external attachment to a wall of a room having a smoke detector. By combining a light switch with the remote battery access device monitoring of the battery module may be improved because light switches may be frequently used everyday by the occupants of the building, so that the battery module will also be viewed frequently. Alternatively, the battery module may be disposed in a single gang electrical box that may be mounted to a wall stud of the building at a height and location that permits convenient access and monitoring of the battery module to occupants of the building.

The battery holder of the battery module is shaped to retain the battery that is normally installed in the battery compartment of the smoke detector. The battery holder also includes electrical contacts that are electrically connected to the wires and are disposed to engage the terminals of the battery when held by the battery holder.

The battery module may also include an installed battery indicator. The installed battery indicator indicates whether a battery is currently held by the battery holder. In one configuration, when a battery is not held within the battery holder, a flag may extend from the battery module. The flag may be brightly colored to attract attention to the lack of a battery supporting the operation of the smoke detector. For example, the flag may be orange, red, yellow, green, or even glow in the dark.

Alternatively, the installed battery indicator may indicate whether a battery is not held within the battery holder by changing the color seen in an indicator window. To provide the changing of color in the indicator window, a colored structure may be disposed adjacent the indicator window when a battery is absent from the battery holder. The colored structure moves away from the indicator window when a battery is installed in the battery holder.

The battery module may also include a low battery indicator using conventional circuitry that flashes a light emitting diode (LED) with similar circuitry used on currently available smoke detectors. Thus, when the smoke detector begins to emit an audible signal to indicate that the charge in a connected battery is low, the LED of the battery module will also flash to help indicate which smoke detector battery needs to be replaced.

Alternatively, a battery test strip may be included that would indicate the charge of the battery. The battery test strip may be electrically connected at one end to a terminal of the battery. The unattached end is connected to a button that when pressed to moves the unattached end into electrical communication with the other terminal of the battery permitting the battery test strip to indicate the charge of the battery.

The battery module of the remote battery access device may also include a wall plate shaped to cover the battery holder disposed within the housing. Because light switches or electrical outlets may be installed with the battery holder, the wall plate may be shaped to accommodate light switches and/or electrical outlets.

The wall plate may also include a door for installing and removing a battery. The door may be hinged or alternatively, may be fully removed to provide access through an access aperture in the wall plate.

Additionally, the wall plate may include a number of features that permits the status of the battery to be monitored with the door closed over the access aperture in the wall plate. For example, the wall plate may have a flag port that permits a flag of the installed battery indicator to extend from the wall plate when a battery is not installed within the battery holder. Alternatively, the wall plate, including the door of the wall plate, may have a window that permits an LED, the battery test strip, or the colored structure to be seen. Further, the wall plate may include a button assembly that permits a contact of the battery test strip to be selectively placed in electrical contact with a terminal of a battery installed in the battery holder.

These and other features and advantages of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the remote battery access device of the present invention, as represented in FIGS. 1A through 6B, is not intended to limit the scope of the invention, as claimed, but is merely representative of presently preferred embodiments of the invention.

Figure 1A:
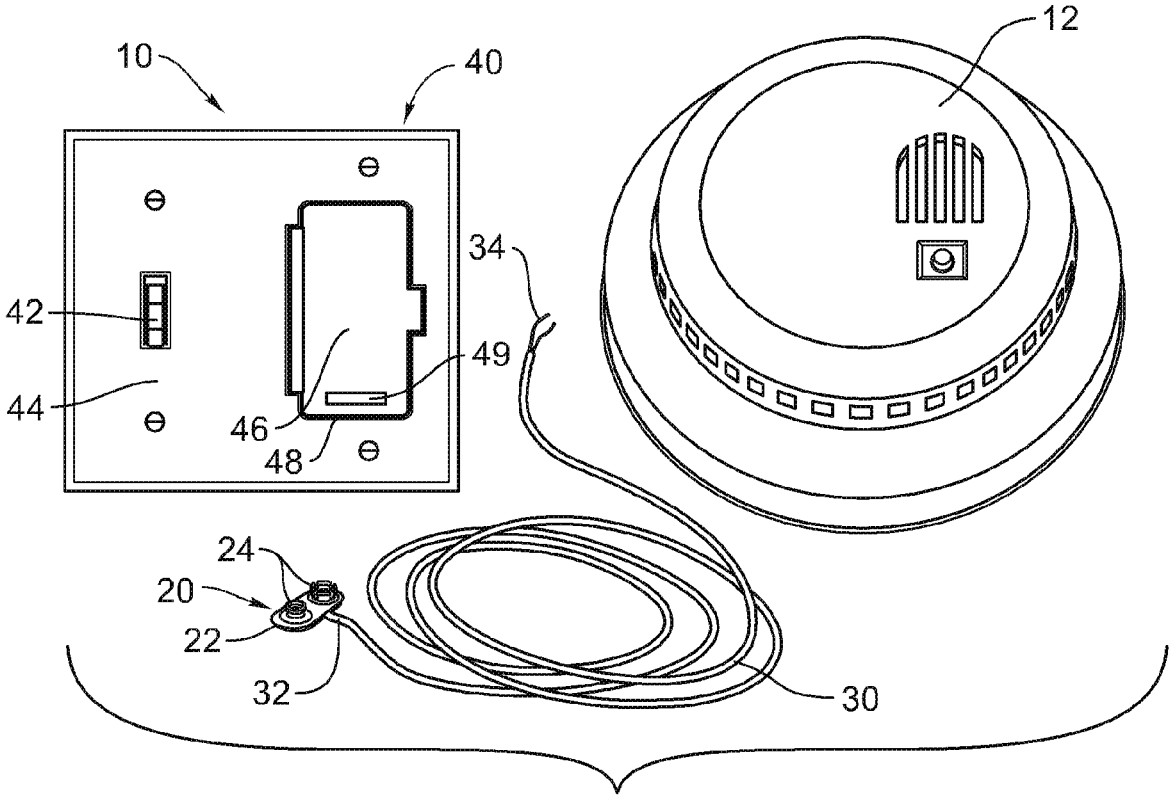
FIGS. 1A, 1B, 1C, 1D, 1E, and 1F illustrate one embodiment of the remote battery access device.

FIGS. 1A, 1B, 1C, 1D, 1E, and 1F, illustrate an embodiment of the remote battery access device 10 and its electrical connection to a smoke detector 12. More specifically, FIG. 1A shows the general components of the remote battery access device 10. As shown, the remote battery access device 10 is not connected to the smoke detector 12, but includes an electrical connector 20 for connecting the remote battery access device 10 to the smoke detector 12. The electrical connector 20 may be a 9V battery snap connector 22 with wires 30 having a first end 32 connected to the electrical connector 20. The electrical connector 20 includes electrical contacts 24.

The second end 34 of the wires 30 is connected to the battery module 40. As shown, the battery module 40 is combined with a light switch 42. Because the light switch 42 may be disposed in a room that also contains a smoke detector, monitoring of the battery module 40 may be improved as the battery module 40 may be frequently viewed everyday by the occupants of the room.

The battery module 40 also includes a wall plate 44 having a hinged door 46 and an access aperture 48. As shown, the door 46 is in a closed configuration and covers the access aperture 48 which permits the battery holder and battery (shown in FIG. 1B) to be accessed through the wall plate 44. The wall plate 44 may also include a window 49 that is disposed on the door 46 which permits an occupant to visually see if a battery is currently installed within the battery module 40.

Figure 1B:
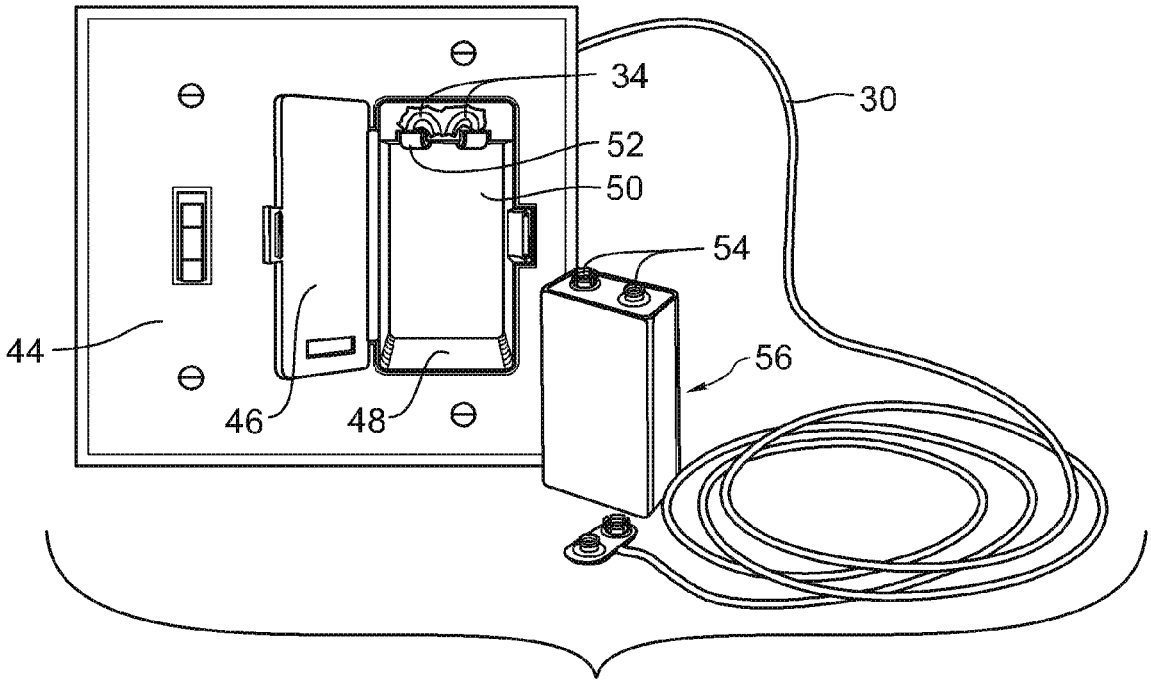

FIG. 1B shows the door 46 of the wall plate 44 in an open configuration that reveals a battery holder 50. The battery holder 50 includes two electrical contacts 52 for engaging the terminals 54 of the battery 56. The electrical contacts 52 are in electrical communication with the second end 34 of the wires 30.

Figure 1C:
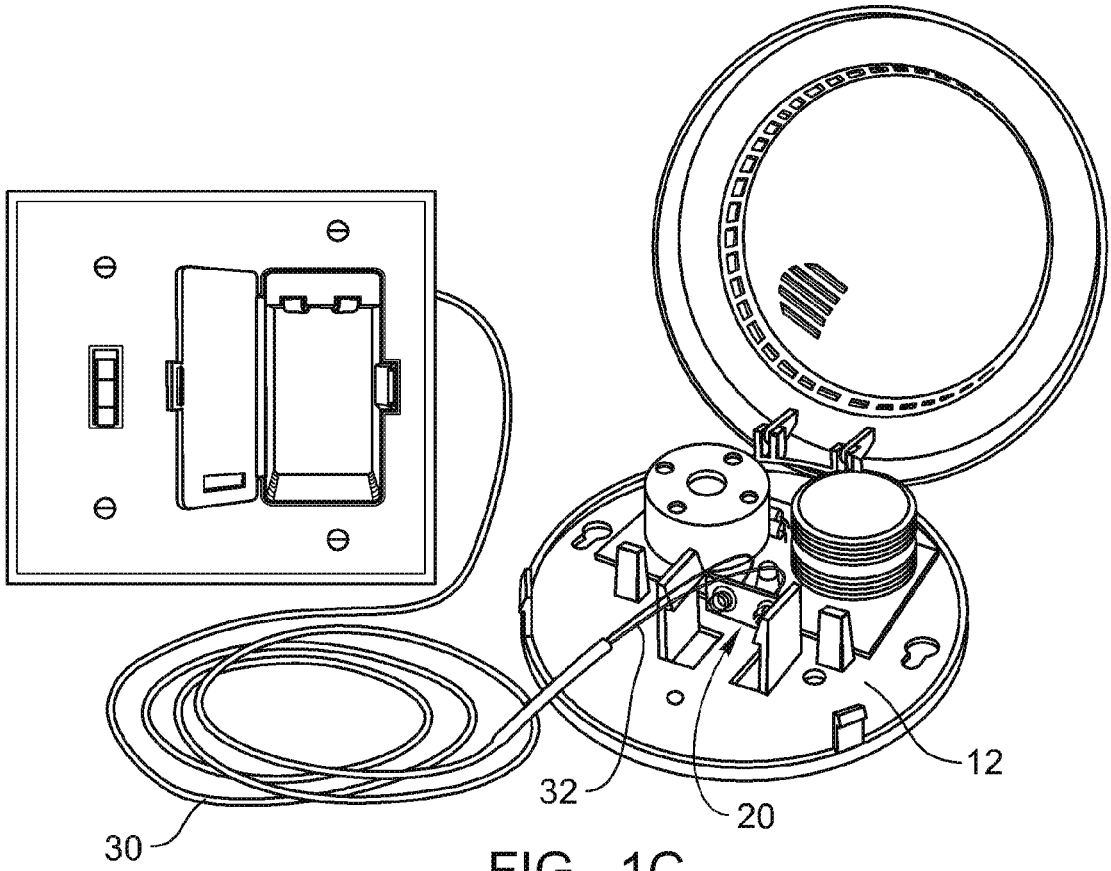
Figure 1D:
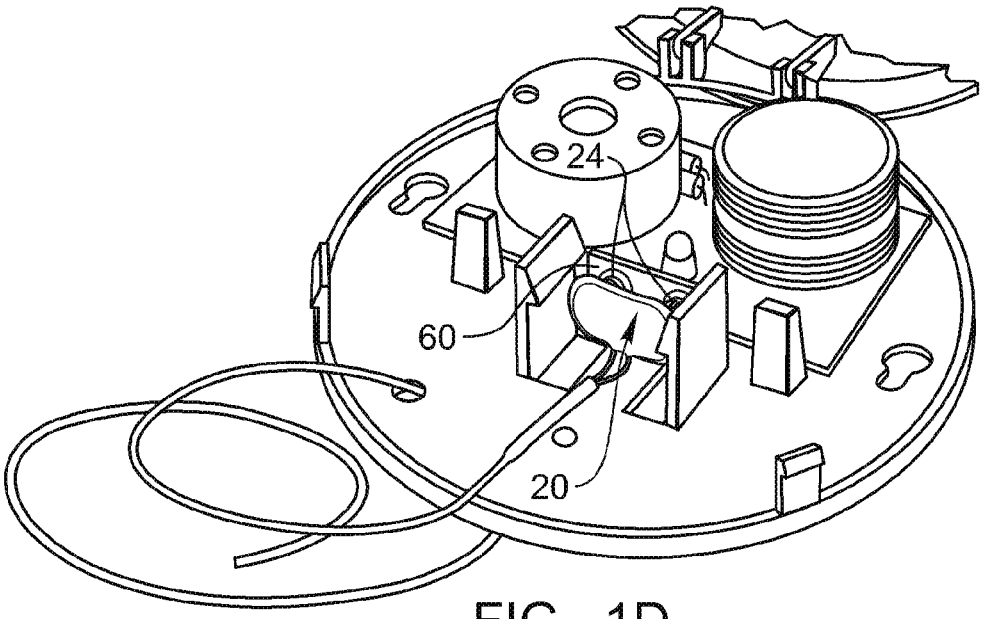

As shown in FIG. 1C, the first end 32 of the wires 30 may be directly connected to the smoke detector 12. More specifically, the electrical contacts 24 of the electrical connector 20 are shown in FIG. 1D as being connected to the electrical connector 60 of the smoke detector 12.

Figure 1E:
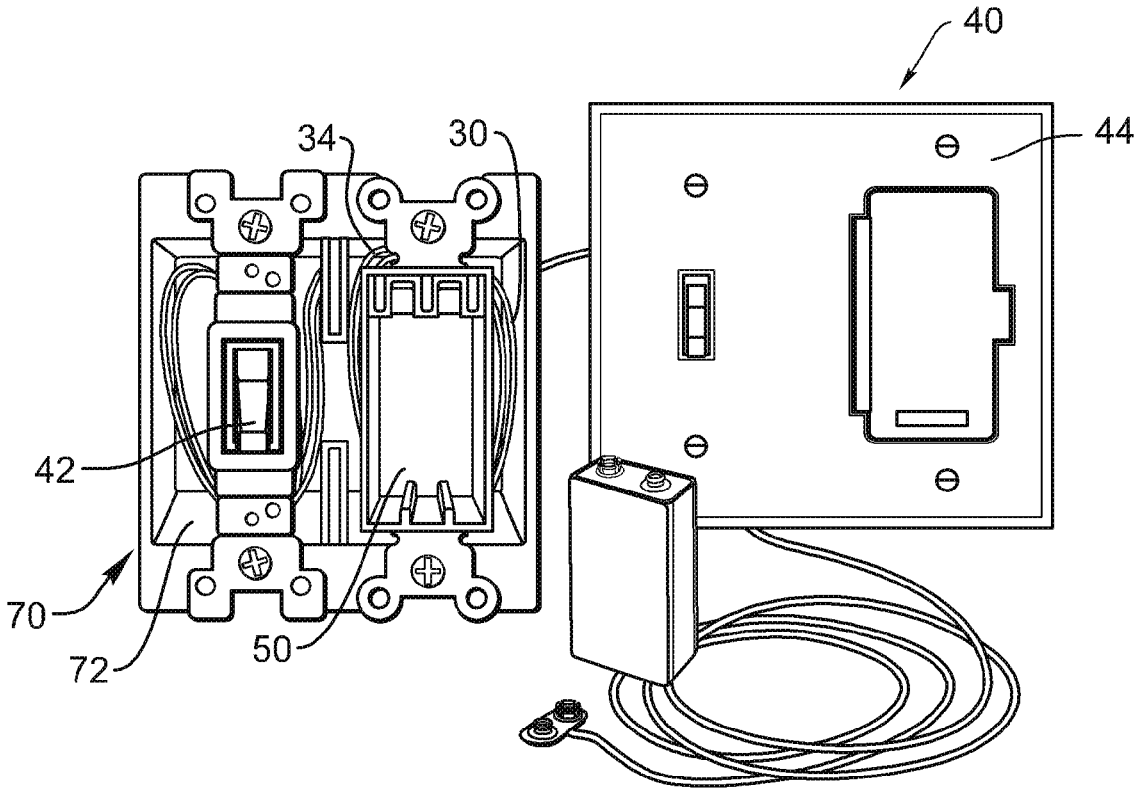
Figure 1F:
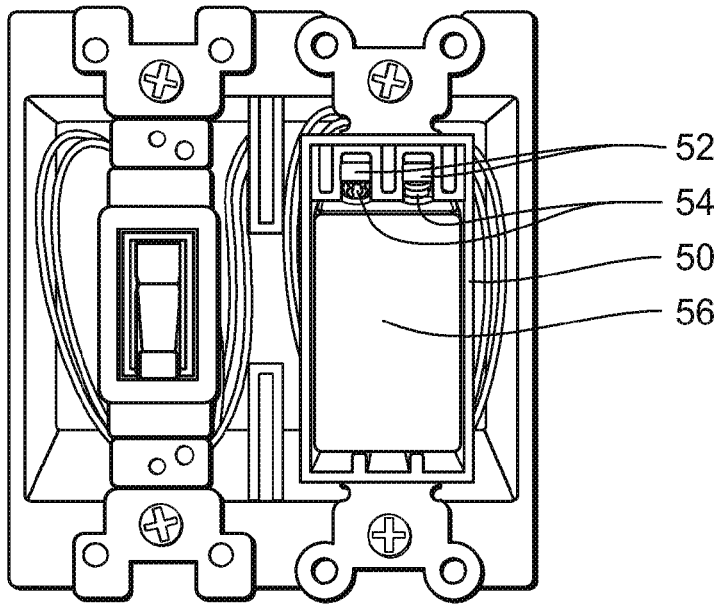

FIG. 1E illustrates the battery module 40 with its wall plate 44 removed. As shown, the light switch 42 and the battery holder 50 are attached to a housing 70, which in the illustrated embodiment is a double gang electrical box 72. Further, FIG. 1E shows the second end 34 of the wires 30 as being directly connected to the electrical contacts 52 of the battery holder 50. In some configurations, the second end 34 of the wires 30 may be soldered to the electrical contacts 52 of the battery holder 50. Additionally, FIG. 1F shows the terminals 54 of the battery 56 contacting the electrical contacts 52 of the battery holder 50.

Figure 2:
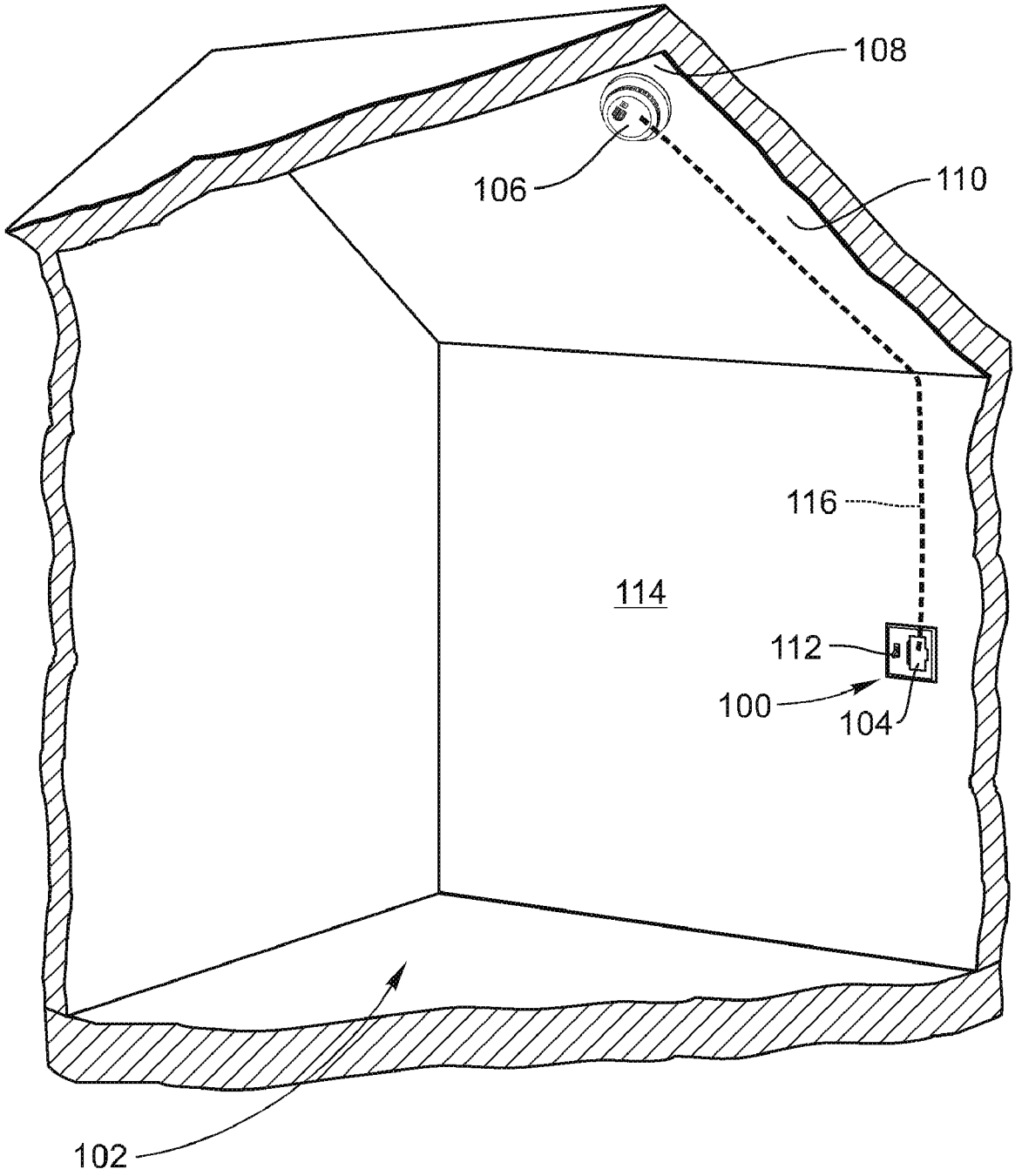
FIG. 2 is a perspective view of a remote battery access device installed within a room of a building and connected to a smoke detector.

Referring to FIG. 2, a perspective view illustrates a remote battery access device 100 installed within a room 102 of a building. The remote battery access device 100 includes a battery module 104 that is disposed remotely from a smoke detector 106. The smoke detector 106 is attached to an upper portion 108 of a vaulted ceiling 110 of the room 102. By being positioned on the upper portion 108 of the vaulted ceiling 110, the smoke detector 106 may more quickly detect smoke but may be difficult to access, especially to install or replace a battery.

In contrast, the remote battery access device 100 provides convenient access to a battery, such as shown in FIG. 1B, of the smoke detector 106 by moving the battery of the smoke detector 106 to a more accessible location. In this configuration of the invention, the battery module 104 includes a light switch 112 so that the battery module 104 is attached to a wall 114 of the room 102 at a convenient height, such as the height normally provided for light switches. Thus, building occupants, regardless of their physical condition or status, may monitor, install, and change the battery of a smoke detector 106 that may be installed on the ceiling 110. To remotely position the battery module 104 from the smoke detector 106, the remote battery access device 100 also includes wires 116, shown in phantom lines, that electrically connect the battery module 104 with the smoke detector 106.

Figure 3A:
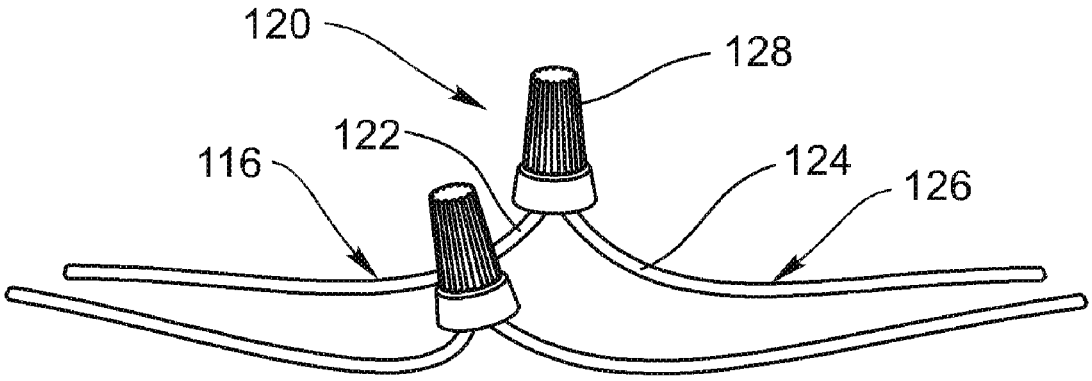
FIGS. 3A and 3B are perspective views of alternative electrical connectors of the remote battery access device.

Referring to FIG. 3A, a perspective view illustrates an electrical connector 120 that may be used with the remote battery access device 100 shown in FIG. 2. As shown, an end 122 of the wires 116 may be twisted together with an end 124 of the battery wires 126 of the smoke detector 106 and placed within the electrical cap 128 to prevent shorting.

Figure 3B:
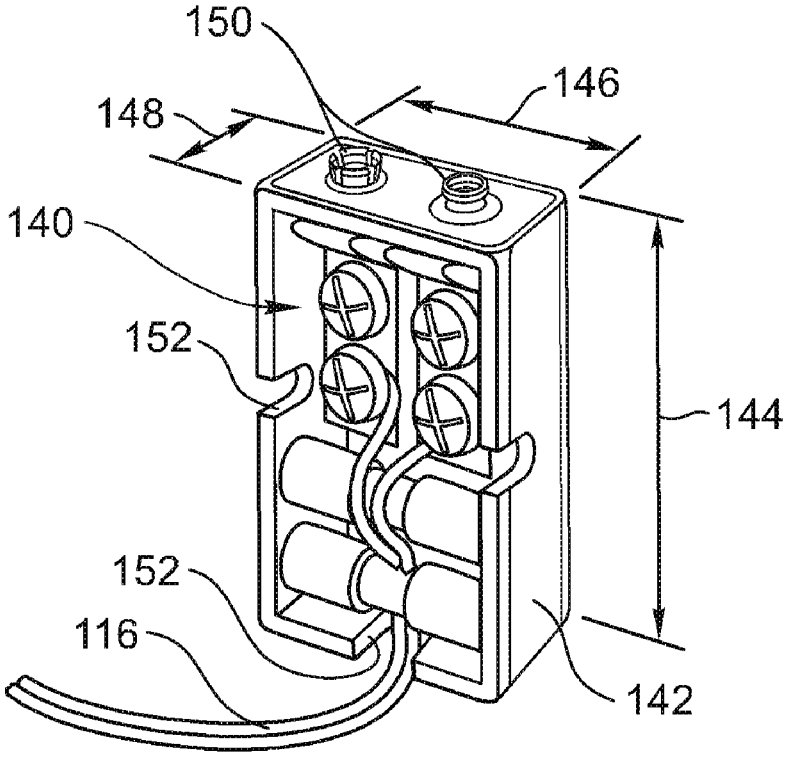

FIG. 3B illustrates an alternative electrical connector 140 that may be used with the remote battery access device 100 shown in FIG. 2. The electrical connector 140 provides the advantage of being shaped to be installed in a wide variety of battery compartments of smoke detectors. The electrical connector 140 is pseudo-battery, simulating the dimensions of the smoke detector battery to enable the pseudo-battery to be installed in the smoke detector in place of the smoke detector battery. Specifically, the electrical connector 140 includes a structure 142 that has dimensions, length 144, width 146, and thickness 148, similar to the type of battery that is normally installed within the smoke detector 106. For example, the structure may have the dimensions of a 9V battery, an AA battery, a 123A battery, and other batteries known in the art. The electrical connector 140 also includes two electrical contacts 150 disposed to engage the corresponding contacts of the smoke detector 106, such as electrical contacts 60 illustrated in FIG. 1D.

As shown, the electrical contacts 150 are connected to the wires 116. When installed in the battery compartment, such as illustrated in FIG. 1D, of the smoke detector 106, the wires 116 may be oriented to conveniently exit the structure 142 by passing through orientation slots 152 that help to properly position and prevent damage to the wires 116 as they exit the smoke detector 106 of FIG. 2.

Figure 4A:
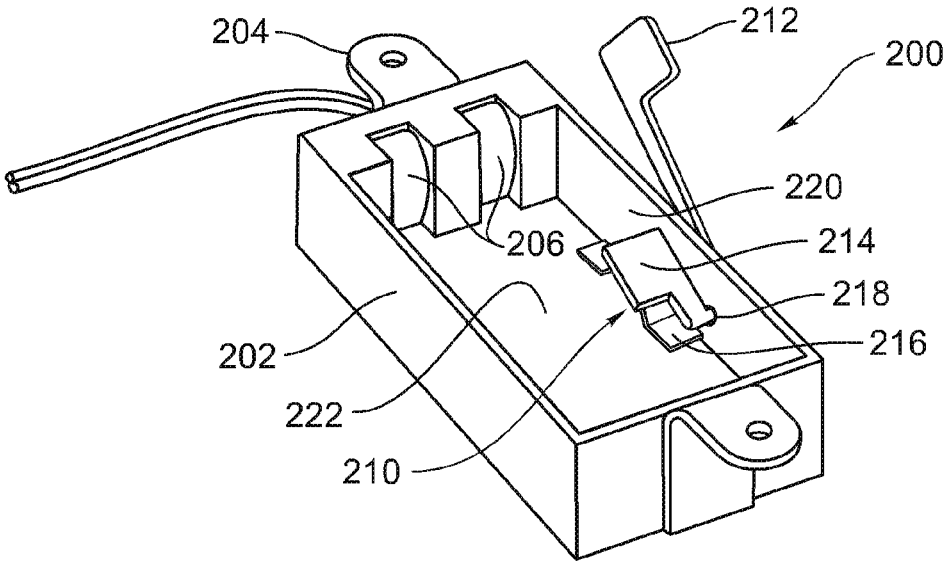
FIGS. 4A, 4B, and 4C are a perspective view and front views, respectively, of alternative installed battery indicators coupled with a battery holder.

Referring to FIG. 4A, a perspective view shows a battery holder 200 that may be part of the battery module 104 of FIG. 2 and connected to the wires 116. As shown, the battery holder 200 includes a frame 202 for supporting a battery, such as battery 56 illustrated in FIG. 1B. Mounting tabs 204 are attached to the frame 202. The mounting tabs 204 permit the battery holder 200 to be attached to a housing, such as housing 302 illustrated in FIG. 5, of the battery module 104.

The battery holder 200 also includes electrical contacts 206 that are disposed within the frame 202 to engage the terminals of a battery. The electrical contacts 206 are in electrical communication with the wires 116 in order to supply power from a battery to the smoke detector 106 of FIG. 2.

The battery module 104 may also include an installed battery indicator 210. In this configuration, the installed battery indicator 210 includes a flag member 212, a lever arm 214, and a spring 216. The flag member 212 and the lever arm 214 are attached together through a hole 218 in a sidewall 220 of the battery holder 200. When a battery is not installed in the battery holder 200, the spring 216 biases the lever arm 214 and the flag member 212 to pivot away from a rear wall 222 of the battery holder 200. In this configuration, the flag member 212 may extend through a wall plate, such as wall plate 400 illustrated in FIG. 6A, of the battery module 104 to indicate that a battery is not installed in the battery holder 200.

When a battery is installed in the battery holder 200, the battery pivots the lever arm 214 toward the rear wall 222 of the battery holder 200 and compresses the spring 216. Thus, the flag arm 212 is also pivoted toward the rear wall 222 of the battery holder 200, which moves the flag arm 212 behind the wall plate and out of the view of an occupant of the building.

Figure 4B:
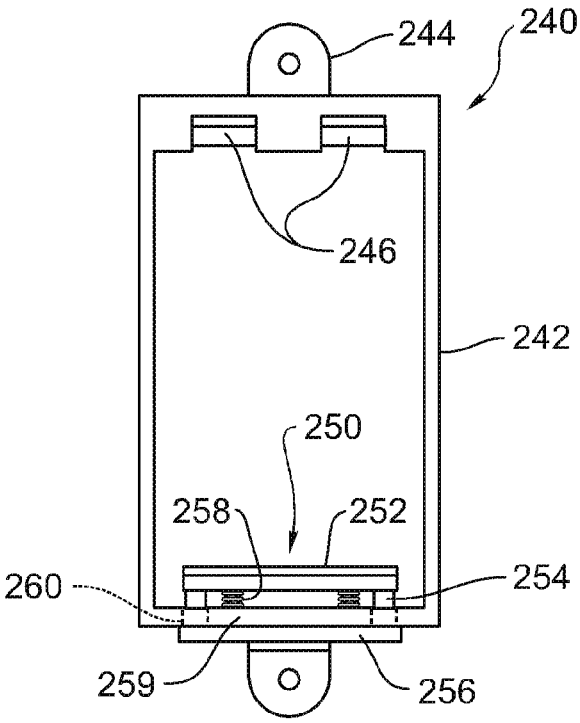

Referring to FIG. 4B, a front view illustrates another battery holder 240 that may be part of the battery module 104 of FIG. 2. Like the battery holder 200 of FIG. 4A, the battery holder 240 of FIG. 4B also includes a frame 242, mounting tabs 244, and electrical contacts 246.

As shown, an installed battery indicator 250 is coupled with the battery holder 240. The installed battery indicator 250 includes an engagement member 252, support arms 254, a colored structure 256, and springs 258. The engagement member 252 is disposed to engage the bottom of a battery installed in the battery holder 240. When engaging the bottom of a battery, the engagement member 252 compresses the springs 258 and is moved toward a bottom wall 259. The engagement member 252 also moves the support arms 254 through support holes 260 (shown in phantom) to move the colored structure 256 away from the bottom wall 259 of the battery holder 240.

When a battery is not present, the springs 258 bias the engagement member 252 away from the bottom wall 259 so that the colored structure 256 may abut the bottom wall 259 and is aligned with an indicator window of a wall plate, such as illustrated in FIG. 1A. By aligning the colored structure 256 with an indicator window of a wall plate, such as window 49 shown in FIG. 1A, the color seen through the indicator window changes from an empty darkness to the color of the colored member 256.

Figure 4C:
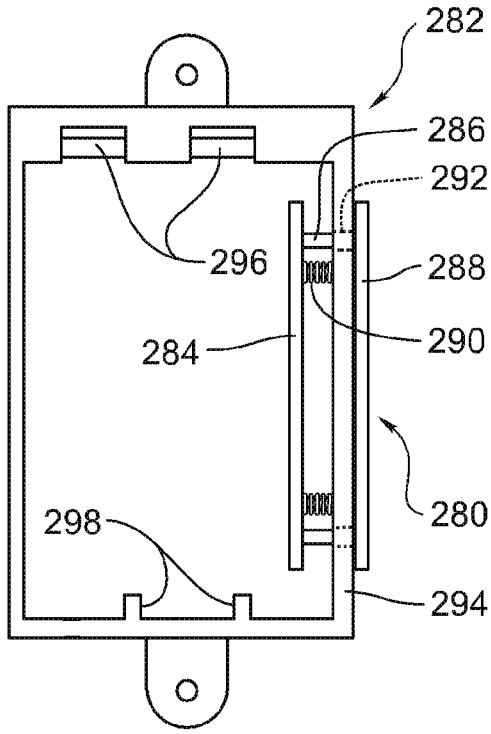

FIG. 4C shows another alternative installed battery indicator 280 coupled with a battery holder 282. The installed battery indicator 280 is similar to the installed battery indicator 250 of FIG. 4B so that it similarly includes an engagement member 284, support arms 286, a colored structure 288, and springs 290. However, the installed battery indicator 280 is disposed so that the support arms 286 extend through a hole 292 (shown in phantom lines) in the sidewall 294. Therefore, when the engagement member 284 does not engage a side of a battery, the long colored structure 288 is aligned with an indicator window of a wall plate, such as wall plate 410 illustrated in FIG. 6B, and extends vertically. When a battery is present, the colored structure 288 is moved out of alignment with the indicator window 412 of the wall plate 410.

The battery holder 282 is wider than the battery holder 240 of FIG. 4B in order to accommodate the sidewall 294 position of the installed battery indicator 280. The battery holder may also include electrical contacts 296 and positioning ridges 298 that help to properly position a battery to engage the electrical contacts 296.

Figure 5:
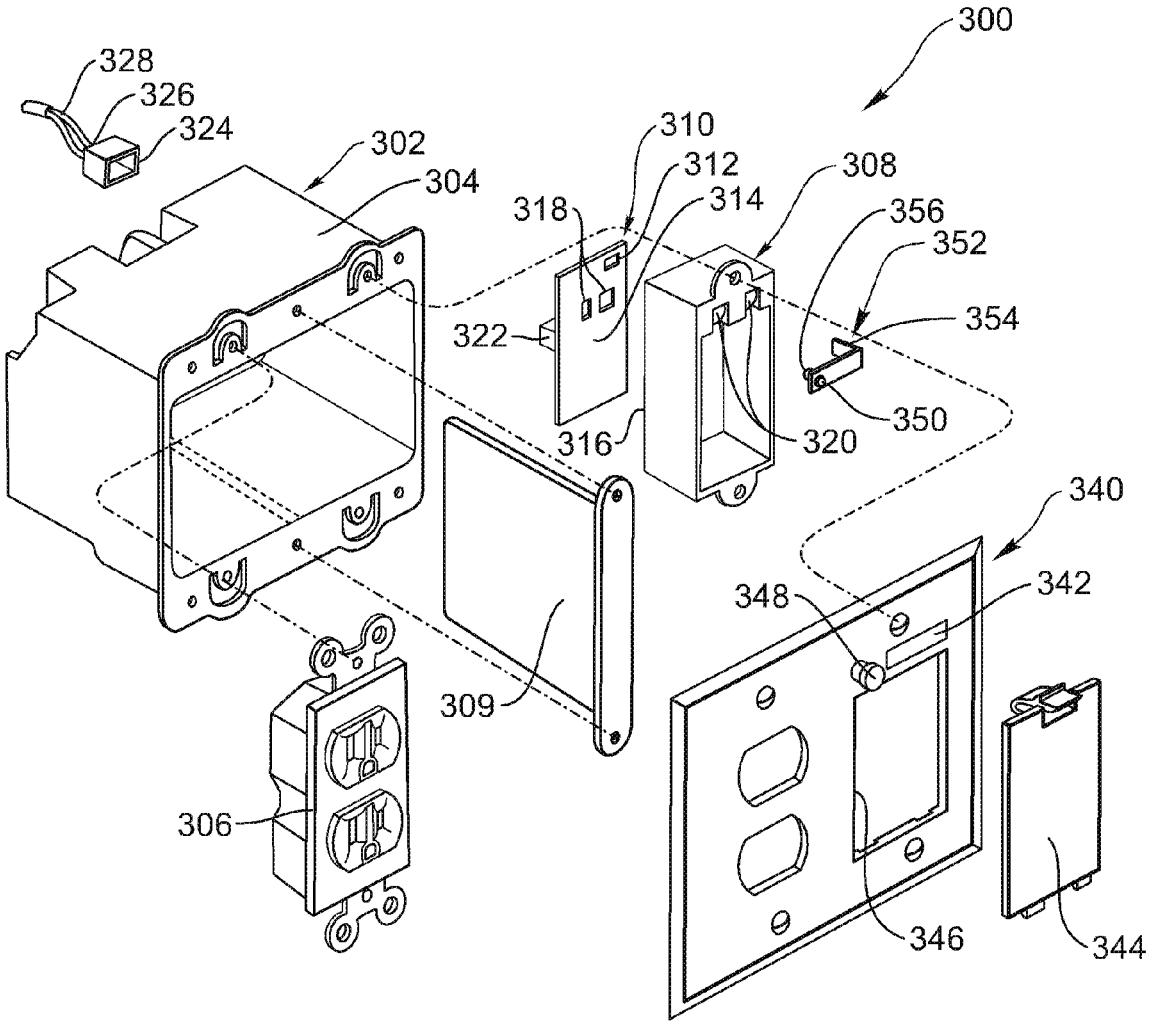
FIG. 5 is an exploded view of a battery module according to the invention.

Referring to FIG. 5 is an exploded view of a battery module 300. The battery module 300 includes a housing 302, which, is a double gang electrical box 304. The battery module 300 also includes an electrical outlet 306 and a battery holder 308 that may be attached to the housing 302. A divider 309 may optionally be installed in the housing 302 to electrically separate high voltage wiring, such as wiring associated with the electrical outlet 306 or a light switch, and low voltage wiring associated with the battery and smoke detector.

As shown, a low battery indicator 310 may be attached to the battery holder 308. The low battery indicator 310 may be similar to the low battery indicator in a smoke detector but instead of beeping, it includes an LED 312 that periodically flashes when the charge on the battery, such as battery 56 illustrated in FIG. 1B, falls below a certain level to indicate that the battery held by the battery holder 308 should be replaced. The low battery indicator 310 may be disposed on a circuit board 314 that may be attached to a rear surface 316 of the battery holder 308.

The circuit board 314 may include footpads 318 for soldered attachment to the electrical contacts 320 of the battery holder 308. The circuit board 314 may also include a connector 322 that permits the battery holder to be quickly connected to a reciprocal connector 324 disposed on an end 326 of wires 328 that may extend to a remotely positioned smoke detector, such as illustrated in FIG. 2.

The battery module 300 may also include a wall plate 340 having a window 342 for viewing the LED 312 of the low battery indicator 310 and a door 344 for closing an access aperture 346 in the wall plate 340. The window 342 may be a hole through the wall plate 340 or may be of a clear material, such as a clear acrylic polymer. The access aperture 346 permits access to the battery holder 308 through the wall plate 340, while the door 344 may be used to hide the battery holder 308. As shown, the door 344 may be fully removed.

The wall plate 340 may also include a button 348. The button 348 may be attached to a first end 350 of a battery test strip 352. A second end 354 of the battery test strip 352 may be attached to one of the electrical contacts 320 of the battery holder 308. The battery test strip 352 includes a contact 356 disposed so that when the button 348 is depressed, the contact 356 engages the other electrical contact 320 of the battery holder 308, which permits the battery test strip 352 to indicate the charge of a battery held by the battery holder 308. The window 342 in the wall plate 340 may be sized so that the battery test strip 352 may be viewed in addition to or in place of the flash of the LED 312.

Figure 6A:
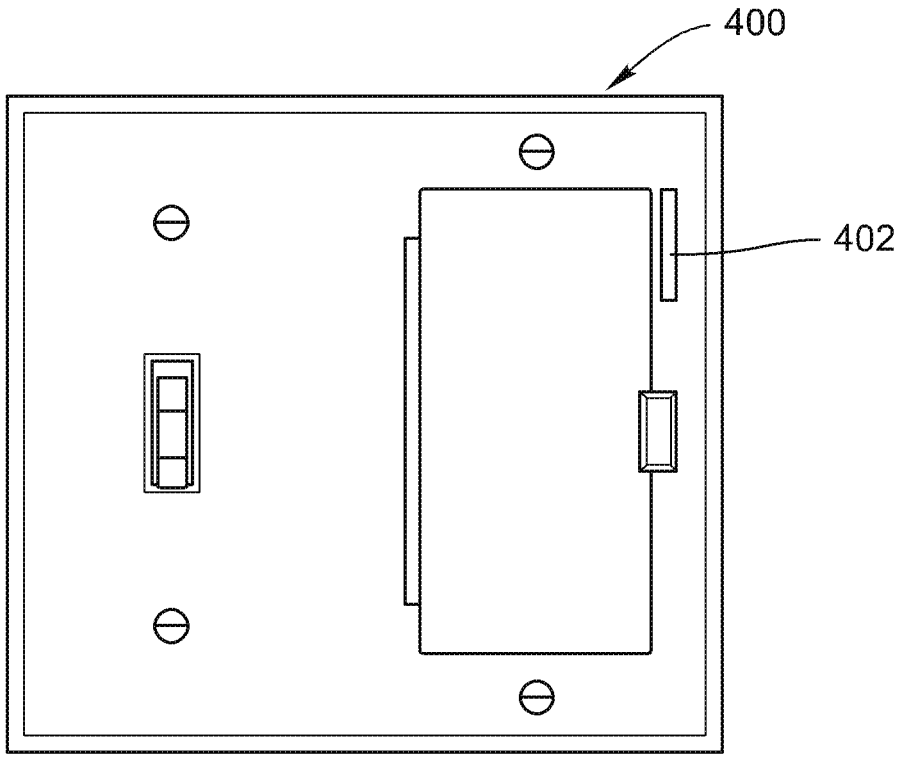
FIGS. 6A and 6B are front views of alternative wall plates of a battery module.

Referring to FIGS. 6A, a front view illustrates an alternative wall plate 400. As shown, the wall plate 400 may include a flag slot 402 that permits the flag member 212 shown in FIG. 4A to extend from the battery holder 200 and past the face plate 400.

Figure 6B:
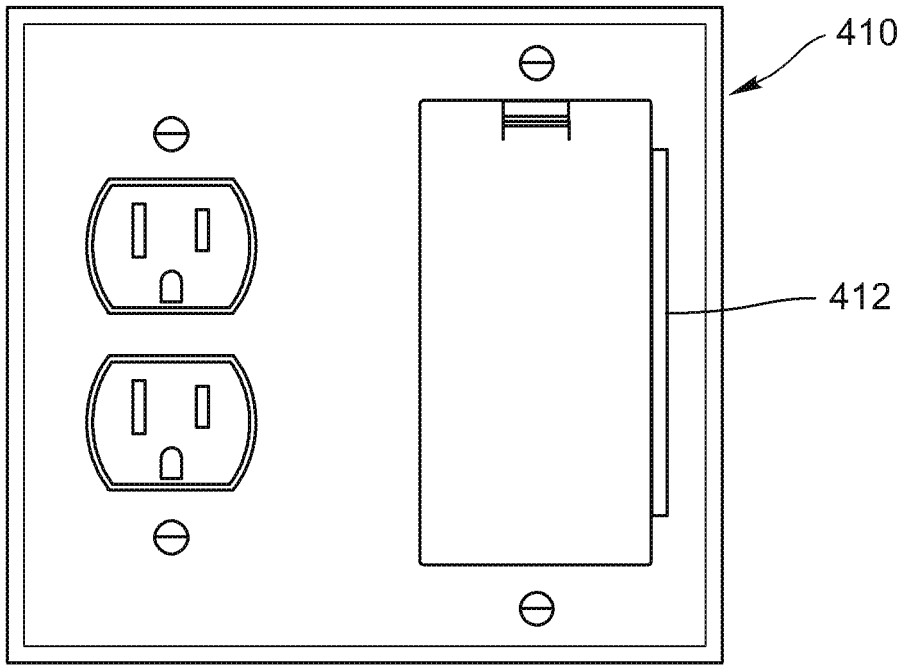

FIG. 6B shows another alternative wall plate 410 that includes a vertical window 412. The vertical window 412 may be aligned with the installed battery indicator 250 of FIG. 4C to indicate whether a battery is installed in the battery holder 240 of FIG. 4*c*.

Appendix A is color photographs of embodiments of the remote battery access device. As shown, the photographs include unlabeled photographs of FIGS. 1A-1F as well as other photographs illustrating a different embodiment of the invention. Additionally, one of the photographs illustrates another installed battery indicator on a smoke detector that may be incorporated into the remote battery access device of the invention. The installed battery indicator operates to prevent a cover from being closed that covers the battery holder of the smoke detector.

In conclusion, a remote battery access device is disclosed that permits a smoke detector battery to be remotely positioned from the smoke detector and conveniently located for monitoring and maintenance of the smoke detector battery. Because of the convenient positioning of the battery module within an occupant's physical reach and normal range of vision, the occupants are better able to and may be reminded to maintain their smoke detectors in an operational state. Thus, the remote battery access device of the invention may save lives by encouraging and permitting the occupants of a building to properly maintain their smoke detectors so that they will function in the event of a fire and alert the occupants to leave the building. Additionally, the remote battery access device of the invention may be made inexpensively from currently available components as illustrated in FIGS. 1A-1F and 6B.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A remote battery access device for remotely positioning a smoke detector battery from a smoke detector, the remote battery access device comprising:

a battery module having a battery holder configured to retain the smoke detector battery and to create an electrical connection with the battery; and a plurality of wires having a first end for connecting to the battery module and a second end for connecting to a smoke detector, wherein the plurality of wires have a sufficient length to permit the battery module to be disposed remotely from the smoke detector for convenient monitoring and replacement of the smoke detector battery.

2. The remote battery access device according to claim 1, further comprising an electrical connector for electrically connecting the second end of the wires to a smoke detector.

3. The remote battery access device according to claim 2, wherein the electrical connector is a 9V battery snap connector attached to the second end of the wires.

4. The remote battery access device according to claim 2, wherein the electrical connector comprises a pseudo-battery simulating the dimensions of the smoke detector battery to enable the pseudo-battery to be installed in the smoke detector in place of the smoke detector battery.

5. The remote battery access device according to claim 4, wherein the pseudo-battery simulates the dimensions of a 9V battery.

6. The remote battery access device according to claim 1, further comprising a housing sized and configured to be installed on a wall of a room, within which the battery module is disposed.

7. The remote battery access device according to claim 6, wherein a light switch or an electrical socket is disposed within the housing in combination with the battery module.

8. The remote battery access device according to claim 7, wherein housing comprises a single, double, triple, or more gang electrical box.

9. The remote battery access device according to claim 6, further comprising a wall plate sized and configured to cover the battery holder disposed within the housing.

10. The remote battery access device according to claim 9, wherein the wall plate comprises a door for installing and removing the battery.

11. The remote battery access device according to claim 1, further comprising a housing sized and configured to be installed for external attachment to a wall of a room, within which the battery module is disposed.

12. The remote battery access device according to claim 1, wherein the battery holder of the battery module is sized and configured to retain the battery that is normally installed in the smoke detector.

13. The remote battery access device according to claim 1, wherein the battery holder comprises electrical contacts that are electrically connected to the first end of the wires and that engage the terminals of the battery when disposed within the battery holder.

14. The remote battery access device according to claim 1, wherein the battery module comprises an installed battery indicator that indicates whether a battery is currently disposed within the battery holder.

15. The remote battery access device according to claim 1, wherein the battery module comprises a low battery indicator that provides a visible or audible signal.

16. A smoke detector assembly comprising:

a smoke detector designed to be powered by a smoke detector battery;

a battery module having a battery holder sized and configured to retain the battery and to create an electrical connection with the battery; and a plurality of wires connecting the smoke detector with the battery module, wherein the plurality of wires have a sufficient length to permit the battery module to be disposed remotely from the smoke detector for convenient monitoring and replacement of the smoke detector battery.

17. The smoke detector assembly according to claim 16, further comprising a housing sized and configured to be installed on a wall of a room, within which the battery module is disposed.

18. The smoke detector assembly according to claim 16, wherein the battery module comprises a low battery indicator that provides a visible or audible signal.

19. A method of remotely positioning a smoke detector battery from a smoke detector comprising:

disposing a battery module remotely from the smoke detector, wherein the battery module has a battery holder sized and configured to retain the battery and to create an electrical connection with the battery;

electrically connecting the battery module to the smoke detector wherein the battery in the battery module provides electrical power to the smoke detector.

20. The method of remotely positioning a smoke detector battery from a smoke detector according to claim 19, wherein the battery module is electrically connected to the smoke detector by a plurality of wires, wherein the plurality of wires have a sufficient length to permit the battery module to be disposed remotely from the smoke detector for convenient monitoring and replacement of the smoke detector battery.

* * * * *